US006080120A

United States Patent [19]

Sandman et al.

[11] Patent Number: 6,080,120

[45] **Date of Patent: *Jun. 27, 2000**

[54] COMPRESSION SLEEVE FOR USE WITH A GRADIENT SEQUENTIAL COMPRESSION SYSTEM

[75] Inventors: Terry L. Sandman, Toledo, Ohio; Kenneth M. Bolam; Donald H. Peeler, both of Charlotte, N.C.

[73] Assignee: Beiersdorf-Jobst, Inc., Charlotte, N.C.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/617,491

[22] Filed: Mar. 15, 1996

Related U.S. Application Data

[63] Continuation of application No. 08/222,407, Apr. 5, 1994, abandoned.

[51] Int. Cl.[7] ..... A61H 9/00

[52] U.S. Cl. ..... 601/152

[58] Field of Search ..... 601/148–152; 606/202; 128/DIG. 20

[56] References Cited

U.S. PATENT DOCUMENTS

| | | |
|---|---|---|
| 3,288,132 | 11/1966 | Meredith . |
| 3,811,431 | 5/1974 | Apstein . |
| 3,862,629 | 1/1975 | Rotta . |
| 3,885,554 | 5/1975 | Rockwell, Jr. . |
| 3,942,518 | 3/1976 | Tenteris et al. . |
| 4,013,069 | 3/1977 | Hasty . |
| 4,029,087 | 6/1977 | Dye et al. . |

(List continued on next page.)

FOREIGN PATENT DOCUMENTS 0 392 669 10/1990 European Pat. Off. .

OTHER PUBLICATIONS

Kendall Healthcare Products Company brochure entitled "A Clinically Proven Home Regimen to Treat Venous Insufficiency" (1989).

Kendall Healthcare Products Company Instruction Manual entitled "SCD™ Therapeutic System," pp. 1–8 (1989).

Kendall Healthcare Products Company Sep. 1, 1993 letter and brochure entitled "T.E.D.®/SCD™ Compression System."

(List continued on next page.)

*Primary Examiner*—Danton D. DeMille
*Attorney, Agent, or Firm*—Alston & Bird LLP

[57] ABSTRACT

A compression system for applying gradient sequential compression of a patient's limb and accelerating deep venous blood flow in the limb from a source of pressurized fluid is provided. The system includes a means for supplying a source of pressurized fluid, said source having a connector interface comprising at least one outlet port, a connector for providing a continuous fluid passageway between the source of pressurized fluid and a compression sleeve. The compression sleeve includes a pair of dimensionally stable, flexible sheets of fluid impervious material, said sheets comprising a thermoplastic film and a fabric applied together into a unitary sheet and means for securing the thermoplastic films of said sheets together along lines defining at least one inflatable chamber disposed longitudinally along the sleeve. A fitting is secured to one of the thermoplastic films of each chamber and in fluid communication with a source of pressurized fluid for inflating the chamber. There is also provided a means for releasably securing the sleeve around the limb of a patient with the chamber encircling the limb.

7 Claims, 7 Drawing Sheets

U.S. PATENT DOCUMENTS

| | | | |
|---|---|---|---|
| 4,030,488 | 6/1977 | Hasty . | |
| 4,156,425 | 5/1979 | Arkans . | |
| 4,198,961 | 4/1980 | Arkans . | |
| 4,202,325 | 5/1980 | Villari et al. . | |
| 4,206,751 | 6/1980 | Schneider | 601/152 |
| 4,207,875 | 6/1980 | Arkans . | |
| 4,207,876 | 6/1980 | Annis . | |
| 4,253,449 | 3/1981 | Arkans et al. . | |
| 4,280,485 | 7/1981 | Arkans . | |
| 4,311,135 | 1/1982 | Brueckner et al. . | |
| 4,320,746 | 3/1982 | Arkans et al. . | |
| 4,321,929 | 3/1982 | Lemelson et al. . | |
| 4,331,133 | 5/1982 | Arkans . | |
| 4,335,726 | 6/1982 | Kolstedt . | |
| 4,338,944 | 7/1982 | Arkans . | |
| 4,355,632 | 10/1982 | Sandman | 601/152 |
| 4,372,297 | 2/1983 | Perlin . | |
| 4,375,217 | 3/1983 | Arkans . | |
| 4,396,010 | 8/1983 | Arkans . | |
| 4,402,312 | 9/1983 | Villari | 601/152 |
| 4,408,599 | 10/1983 | Mummert . | |
| 4,413,620 | 11/1983 | Tucker . | |
| 4,453,538 | 6/1984 | Whitney | 601/152 |
| 4,481,937 | 11/1984 | Arkans . | |
| 4,574,812 | 3/1986 | Arkans . | |
| 4,577,626 | 3/1986 | Marukawa et al. . | |
| 4,583,522 | 4/1986 | Aronne . | |
| 4,597,384 | 7/1986 | Whitney | 601/152 |
| 4,702,232 | 10/1987 | Gardner et al. . | |
| 4,762,121 | 8/1988 | Shienfeld . | |
| 4,793,328 | 12/1988 | Kolstedt et al. . | |
| 4,827,912 | 5/1989 | Carrington | 601/152 |
| 4,841,956 | 6/1989 | Gardner et al. . | |
| 4,858,596 | 8/1989 | Kolstedt et al. . | |
| 4,922,893 | 5/1990 | Wright et al. . | |
| 4,947,834 | 8/1990 | Kartheus | 601/152 |
| 5,007,411 | 4/1991 | Dye . | |
| 5,022,387 | 6/1991 | Hasty . | |
| 5,031,604 | 7/1991 | Dye . | |
| 5,117,812 | 6/1992 | McWhorter . | |
| 5,179,941 | 1/1993 | Siemssen et al. . | |
| 5,186,163 | 2/1993 | Dye . | |
| 5,263,473 | 11/1993 | McWhorter . | |
| 5,588,954 | 12/1996 | Ribando et al. | 601/149 |

OTHER PUBLICATIONS

Kendall Healthcare Products Company brochure entitled "Making Prevention Operative," (1991).

Kendall Healthcare Products Company information order form entitled "A Clinically Proven Home Regimen to Treat Venous Insufficiency," (1989).

Kendall Healthcare Products Company brochure entitled "The Home Rx™ Vascular Compression System for Healing Venous Ulcers," (1991).

Kendall T.E.D.® Sequential Compression Device Model 5320 Operating Instructions, pp. 1–17, 1985.

Olson et al., "Experimental Studies of External Pneumatic Compression Methods on a Model Human Leg," 32nd ACEMB, Denver Hilton Hotel, Denver, CO, Oct. 6–10, 1979.

Salzman, et al., "Effect of Optimization of Hemodynamics on Fibrinolytic Activity and Antithrombotic Efficacy of External Pneumatic Calf Compression," Annals of Surgery, vol. 206, No. 5, Nov. 1987, pp. 636–641.

Caprini, "Role of Compression Modalities in a Prophylactic Program for Deep Vein Thrombosis," Seminars in Thrombosis and Hemostatsis—Supplement, vol. 14, 1988, pp. 77–87.

Hull, et al., "Effectiveness of Intermittent Pneumatic Leg Compression for Preventing Deep Vein Thrombosis After Total Hip Replacement," JAMA, vol. 263, No. 17, May 2, 1990, pp. 2313–2317.

Bucci, et al., "Mechanical Prophylaxis of Venous Thrombosis in Patients Undergoing Craniotomy: A Randomized Trial," Surg. Neurol. vol. 32, 1989, pp. 285–288.

Jobst brochure entitled, "Athrombic Pump®—System 2000—Intermittent Compression Device."

Jobst 510(k) Notice dated Sep. 25, 1989. Exhibits 1A–6G are attached as follows: Exhibit 1A: photographs of front and rear view of System 2000; Exhibit 1B: photograph of System 2000 with wrap–around pneumatic sleeve and photograph of wrap–around pneumatic sleeve; Exhibit 1C: photograph of System 2000 with disposable wrap–around pneumatic sleeve and photograph of disposable wrap–around pneumatic sleeve.

Exhibit 2A: instructions for operation of Athrombic Pump® System 2000; Exhibit 2B: instructions for operation of Jobst Athrombic Pump System Wrap–Around Pneumatic Sleeve; Exhibit 2C: instructions for operation of Jobst Athrombic Pump System Disposable Wrap–Around Pneumatic Sleeve; Exhibit 2D: instructions for operation of Athrombic Pump® Model 116620, Form 586R6; Exhibit 2E: instructions for operation of Jobst® Anti–Em® Extremity Pump®, Model 116600, Form 582.

Exhibit 3A: front panel label (artwork)—condensed instructions for Jobst Athrombic Pump® System 2000; Exhibit 3B: data plate label; Exhibit 3C: front and back view of Wrap–Around Sleeve label; Exhibit 3D: front and back view of Disposable Wrap–Around Sleeve label; Exhibit 3E: description of Air Chamber label.

Exhibit 4A: Jobst brochure entitled, "Venous Thrombosis in the High–Risk Patient", Form 945 (1987); Exhibit 4B: Jobst article entitled: "Deep Vein Thrombosis," Form 294R3 (1981); Exhibit 4C: Jobst brochure entitled, "Anti–Em® Anti–Embolism Extremity Pump™," Form 639 (1974).

Exhibit 5A: Kendall advertisement; Exhibit 5B: Kendall advertisement for T.E.D./SEC Compression System; Exhibit 5C: Kendall Model 5320 operating instructions—T.E.D.® Sequential Compression Device; Exhibit 5D: Baxter advertisement for Pulsatile Anti–Embolism System; Exhibit 5E: Gaymar Industries, Inc. advertisement for Thrombogard; Exhibit 5F: Lyne–Nicholson, Inc. advertisement for Venodyne; Exhibit 5G: Camp International, Inc. advertisement for Hemaflo; Exhibit 5H: Comparative Chart—Compression Systems for Treatment of D.V.T.

Exhibit 6A: Salzman, et al., "Intraoperative external pneumatic calf compression to afford long–term prophylaxis against deep vein thrombosis in urological patients," Surgery, vol. 87, No. 3, 1980, pp. 239–242.

Exhibit 6B: "Prevention of Venous Thrombosis and Pulmonary Embolism," National Institutes of Health Consensus Development Conference Statement, vol. 6, No. 2.

Exhibit 6C: Hull et al., "Effectiveness of Intermittent Pulsatile Elastic Stokings for the Prevention of Calf and Thigh Vein Thrombosis in Patients Undergoing Elective Knee Surgery" (undated); Exhibit 6D: Coe et al., "Prevention of deep vein thrombosis in urological patients: A controlled, randomized trial of low–dose heparin and external pneumatic compression boots," Surgery, vol. 83, No. 2, 1978, pp. 230–234; Exhibit 6E: Klein et al., "Prevention of Thromboembolism in Urological Patients" (undated); Exhibit 6F: Whalen et al., "Deep Vein Thrombosis—Prophylaxis" (undated); Exhibit 6G: Salzman et al., "Effect of Optimization of Hemodynamics on Fibrinolytic Activity and Antithrombotic Efficacy of External Pneumatic Calf Compression," Ann. Surg., vol. 206, No. 5, 1987, pp. 636–641.

Letter to Food and Drug Administration dated Dec. 20, 1989 supplementing 510(k).

Letter to Food and Drug Administration dated Nov. 9, 1989 supplementing 510(k). Exhibits 1–5D are attached as follows: Exhibit 1: Jobst Institute, Inc. Overview of Deep Vein Thrombosis, Pulmonary Embolism and Discussion of Prophylactic Methods.

Exhibit 2: Jobst Nov. 8, 1989 Memorandum to File from Kotwick Regarding: Evolution of the Design of the Jobst Athrombic Pump.

Exhibit 3A: Jobst Institute, Inc. Engineering Study #89102, Introduction & Methods, Title: Electromagnetic Interference Considerations of the Jobst Athrombic Pump System 2000. Exhibit 3B: Jobst Institute, Inc. Engineering Study #89102, Results & Discussion.

Exhibit 4A: Jobst Institute, Inc., Engineering Study #89101, Introduction & Methods, Title: Performance Comparison of the Jobst Athrombic Pumps. Exhibit 4B: Jobst Institute, Inc., Engineering Study #89101, Results & Discussion.

Exhibit 5A: Graor et al., "The Comparative Evaluation of Deep Vein Thrombosis Prophylaxis in Total Joint Replacement Patents: An Interim Report," presented at the 1989 meeting of the American Academy of Orthopaedic Surgeons. Exhibit 5B: Salzman et al., "Prevention of Venous Thromboembolism in Unstable Angina Pectoris," The New England Journal of Medicine, vol. 306, No. 16, 1982. Exhibit 5C: Moser, "Pulmonary thromboembolism: Your challenge is prevention," The Journal of Respiratory Diseases, vol. 10, No. 10, 1989, pp. 83–85, 88, 91–93. Exhibit 5D: Green et al., "Deep Vein Thrombosis in Spinal Cord Injury: Effect of Prophylaxis with Calf Compression, Aspirin, and Dipyridamole," Paraplegia, vol. 20, 1982, pp. 227–234.

Jobst brochure entitled "Disposable Wrap–Around Pneumatic Sleeves" for use with the Jobst Athrombic Pump System 2000 (Model 142 010).

Jobst brochure entitled "Disposable Wrap–Around Pneumatic Sleeves" for use with the Jobst Athrombic Pump System 2000 (Model 142 000) and Jobst Athrombic Pump (Model 116 620).

Jobst brochure entitled "Wrap–Around Pneumatic Sleeves" (1989).

COMPRESSION SLEEVE FOR USE WITH A GRADIENT SEQUENTIAL COMPRESSION SYSTEM

CROSS REFERENCE TO RELATED APPLICATIONS

This application is related to application Ser. No. 08/223,429, entitled GRADIENT SEQUENTIAL COMPRESSION SYSTEM AND METHOD FOR REDUCING DEEP VEIN THROMBOSIS now U.S. Pat. No. 5,575,762; and is a continuation of application Ser. No. 222,407, entitled CONNECTOR FOR GRADIENT SEQUENTIAL COMPRESSION SYSTEM now abandoned, the disclosures of which are hereby incorporated herein by reference.

BACKGROUND OF THE INVENTION

1. Field of the Invention

The present invention relates to a compression sleeve for use with a system for intermittently squeezing a patient's limb to accelerate the flow of blood therein. More particularly, the present invention relates to a compression system having a means for providing a pressurized fluid, a compression sleeve for applying gradient sequential compression to a patient's limb, and a connector for providing fluid flow between the pressurized source and the sleeve.

2. Description of the Prior Art

External pneumatic leg compression reduces venus stasis by intermittently squeezing the leg and accelerating deep venus blood flow. It also enhances blood fibrinolytic activity. Intermittent compression of the leg is effective against venus thrombosis in patients undergoing many types of surgery. The usual treatment is to wrap compressive sleeves having a plurality of pressure compartments around the limb of a patient and then intermittently pressurize the sleeve to successively apply pressure compression to different parts of the limb.

The prior art devices include a variety of compression devices which provide pressure against a patient's limb through a pressure sleeve which encircles the patient's limb. One of the shortcomings of the compression devices of the prior art is that the chambers of each sleeve are not capable of independent inflation. In some devices pressurized fluid is fed to a first chamber and after a partial inflation air flows to an adjacent chamber through a foam-filled conduit. Another disadvantage of some of the compression sleeves of the prior art is that the devices use air vent openings on the inner side of the sleeve next to the patient's limb to ventilate the limb so that the sleeve will be comfortable. The construction of sleeves of the prior art has been to place an outer sheet over an inner thermoplastic sheet secured only at limited areas. Such sleeve construction does not have good dimensional stability and thus does not retain the best shape during use. In addition, another disadvantage of many of the prior sleeves is that they are not sealed at their outer edges. Yet another disadvantage of the prior art compression sleeves is that some of them do not fit snugly around the patient's limb because the side edges of the sleeve or chamber form a straight line.

SUMMARY OF THE INVENTION

With the foregoing in mind it is therefore a general object of the present invention to provide a compression sleeve for use in a system for preventing the occurrence of deep vein thrombosis and pulmonary embolism in recumbent patients.

Another object of the present invention is to provide a compression system for gradient sequential compression of a patient's limb and accelerating deep venous blood flow therein.

Yet another object of this invention is to provide a compression sleeve made from dimensionally stable flexible sheets of fluid impervious layers laminated together into a unitary sheet.

It is yet another object of the present invention to provide a compression sleeve having an inflatable chamber shaped in an arcuate manner to more comfortably fit the patient's limb during use.

It is a further object of the present invention to provide a compression sleeve for use in a system and method of regulating compressive forces applied to a limb of a user.

These objects are accomplished by the present invention in which a system for gradient sequential compression of a patient's limb and accelerating deep venous blood flow therein is set forth which provides cyclical squeezing and relaxing action to one or more limbs of a patient. This occurs by sequentially establishing a decreasing gradient of compressive forces along the limbs in a proximal direction. Broadly, the device includes a controller system having a pneumatic compressor, a multi-tube connector and at least one compression sleeve having inflatable chambers encircling (or substantially encircling) a patient's limb.

In particular, the compression system includes one or more sleeves (e.g., calf, thigh, calf and thigh, etc.) which can be wrapped around and releasably secured to a limb of a patient. The sleeves have one or more inflatable chambers therein for retaining pressurized fluid upon inflation and for applying a compressive force to a limb. The compression system also includes a system controller for controlling transfers of pressurized fluid to the inflatable chambers of the compression sleeves during respective inflation cycles, and for venting the pressurized air during respective deflation cycles. Transfers of fluid from the system controller to the sleeves is preferably provided by a connector having one or more tubes or conduits.

The compression sleeve for applying compressive pressures against a patient's limb includes a pair of dimensionally stable, flexible sheets of fluid impervious material, said sheets comprising a thermoplastic film and a fabric applied together into a unitary sheet such as by laminating. The thermoplastic films are sealed together, such as by conventional heat sealing or other well known means, along lines defining at least one elongated inflatable chamber disposed longitudinally along the sleeve. A fitting is secured to one of the thermoplastic films of each chamber and in fluid communication with a source of pressurized fluid for inflating the chamber. The sleeve has a fastener for releasably securing it around the limb of a patient with the chamber encircling the limb.

According to another aspect of the invention, compressive forces are applied to a limb of a patient by sequentially compressing a distal portion and relatively proximal portion of the limb to provide respective first and second radially inwardly directed compressive forces thereto. The first compressive force is maintained above the second compressive force so that a decreasing pressure gradient is established in a proximal direction along the limb for a preselected time interval. The force is preferably maintained by measuring the compressive forces and adjusting (i.e., increasing or decreasing) the compressive forces to maintain predetermined forces in each sleeve chamber.

In operation, compressive forces are applied to a limb of a patient using a multi-chambered inflatable limb sleeve surrounding the limb. The method includes the steps of pressurizing a first chamber of the limb sleeve to a first predetermined chamber pressure and then pressurizing a second chamber, disposed proximally relative to the first chamber, to a second preselected chamber pressure, after the first chamber reaches a first threshold pressure. The second threshold pressure may be less than or equal the first predetermined pressure.

Preferably, the second chamber pressurizing step occurs after a pressure in the first chamber has been established at the first predetermined pressure for at least a first time interval. A step is also performed to regulate the pressure in the first and second chambers at their respective predetermined pressures, so that a pressure gradient is established therebetween. The regulating step may also include the steps of measuring a pressure in the first chamber while preventing depressurization of the second chamber and vice versa. Additionally, the regulating step may include the steps of measuring a pressure in the first chamber after it has been inflated to the first threshold pressure and then remeasuring a pressure in the first chamber, after the second chamber has been inflated to the second threshold pressure.

The pressures in the chambers may also be adjusted by performing periodic reinflating steps.

Similar steps may also be performed to inflate third and fourth, etc. chambers of the limb sleeve, in sequence, so that a monotonically decreasing pressure gradient is established between the chambers of a sleeve.

BRIEF DESCRIPTION OF THE DRAWINGS

Other objects, features and advantages of the present invention will become apparent from the following detailed description when taken in conjunction with the accompanying drawings in which.

DETAILED DESCRIPTION OF THE PREFERRED EMBODIMENT

Figure 1:
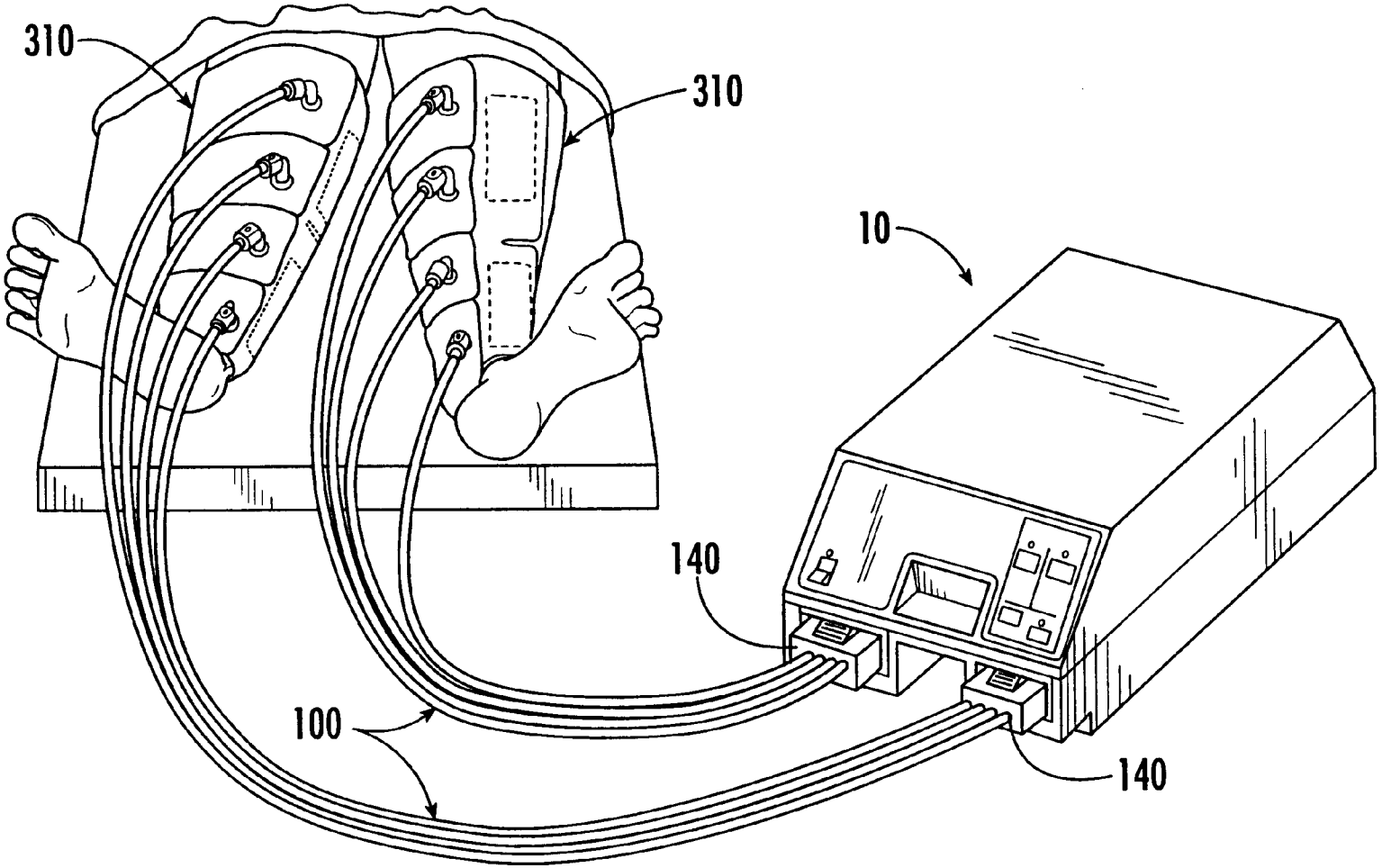
FIG. 1 is a fragmentary perspective view of the compression system of the present invention.

The compression system includes a controller for performing, among other things, real time inflation, monitoring, adjusting and deflation of pneumatic sleeves for gradient sequential compression of a patient's limb and accelerating deep venous blood flow therein. Referring now to FIG. 1, the gradient sequential compression system of the present invention comprises broadly, a controller 10, a pair of multi-tube conduit connectors 100 coupled to a pair of inflatable four chamber compression sleeves 210 which apply gradient sequential compression against a patient's limb.

Figure 2:
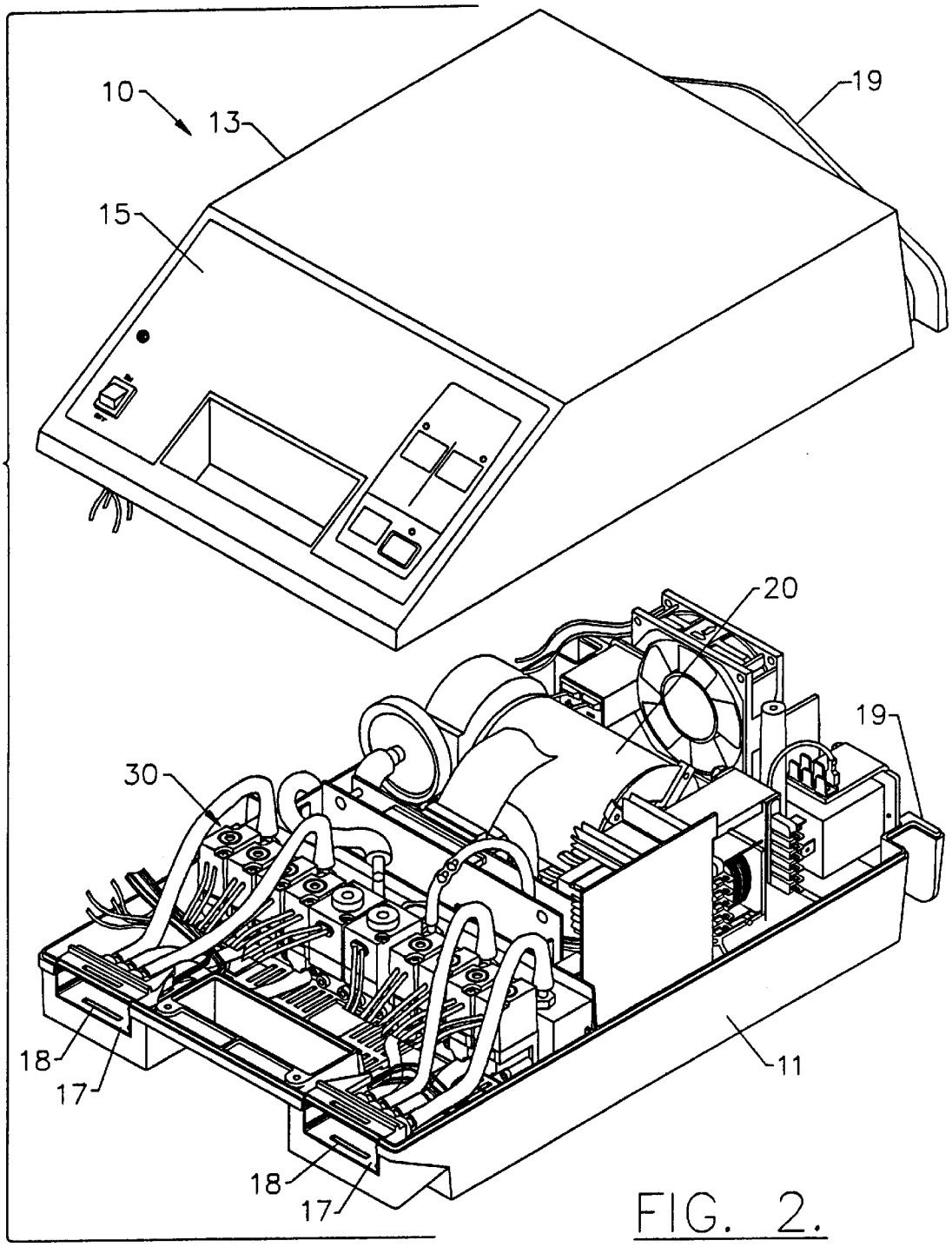
FIG. 2 is a perspective view illustrating the system controller of the present invention with the housing cover removed.

Referring now more specifically to FIG. 2 there is shown a perspective view of a preferred embodiment of the system controller of the present invention generally indicated at 10. As shown in FIG. 2 the system controller 10 includes a housing forming a base 11 and a cover 13. The housing includes a control display panel 15, tube connector outlet ports 17, and a mounting means 19. The control display panel 15 is used to visually communicate chamber inflation information (e.g., pressure levels, chamber status), the mode of operation (e.g., one- or two-limb mode) and alarm, alert and fault conditions. The display may also provide means, responsive to actuation by a user or health care professional, for preselecting the desired pressure levels to be achieved during a sleeve inflation cycle. The system controller 10 includes a pneumatic compressor 20 for supplying compressed fluid through valve manifold 30 having a plurality of valves which connect through outlet ports 17.

Figure 3:
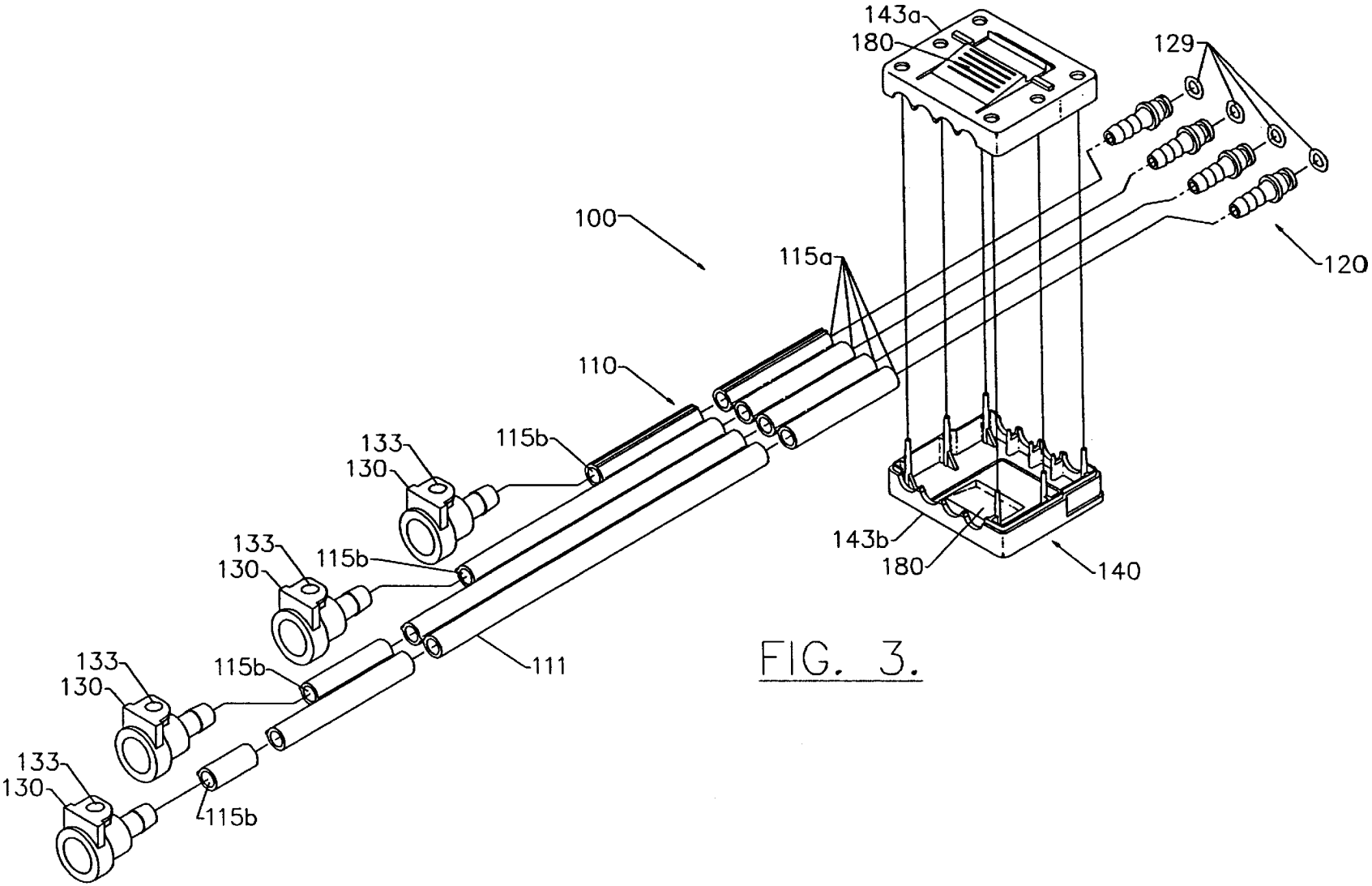
FIG. 3 is an exploded perspective partial view of the multi-tube connector of the present invention.

As shown in FIG. 3, a conduit connector 100 is provided for rapidly connecting and disconnecting to the controller 10 at outlet ports 17 and to one or more inflatable compression sleeves 210 of the present invention for applying gradient sequential compressive pressures against a patient's limb. The conduit connector 100 includes flexible conduits 110, connector inserts 120, couplers 130 and gripping member 140. In a preferred embodiment, the connector 100 interacts with the outlet ports 17 of controller 10 for interconnecting with each of the sleeves 210, one for each leg of the patient.

Flexible conduit 110 comprises a plurality of integrally formed tubes 111 in spaced-apart relation. The flexibility of the conduit 110 allows a user to select a position for the controller 10 which is comfortable for the patient and accessible to the operator while conforming to the space available for operating the compression system of the present invention.

In a preferred embodiment, the conduit 110 is made of soft plastic, such as polyvinyl chloride, and comprises four thin-walled tubes 111 of generally circular cross-section having a first end 115*a* and a second end 115*b*. Tubes 111 define pneumatic passageways for interconnecting each outlet port 17 of the controller 10 to a respective inlet port 223 for each chamber 240, 241 of sleeve 210 (FIG. 4).

At a first end 115*a*, connector 100 includes a plurality of hollow generally cylindrical connector inserts 120. The number of connector inserts 120 corresponds to the number of tubes 111 in conduit 110. Connector inserts 120 may be secured to the ends 115*a* of tubes 111 by any suitable means, but are preferably press fit. O-rings 129 form a tight seal with the receiving holes in outlet ports 17 to prevent the pressurized air from escaping at the connections between connector inserts 120 and outlet ports 17.

At a second end 115*b*, connector 100 includes a plurality of longitudinally-spaced sequential quick release couplers 130. Couplers 130 may be of the type described in U.S. Pat. No. 5,052,725 and do not form a part of the present invention. The number of couplers 130, however, corresponds to the number of tubes 111 in conduit ribbon 110. Couplers 130 are secured to tubes 111 at second end 115*b* by any suitable means such that couplers 130 are not easily removed from tubes 111.

Figure 4:
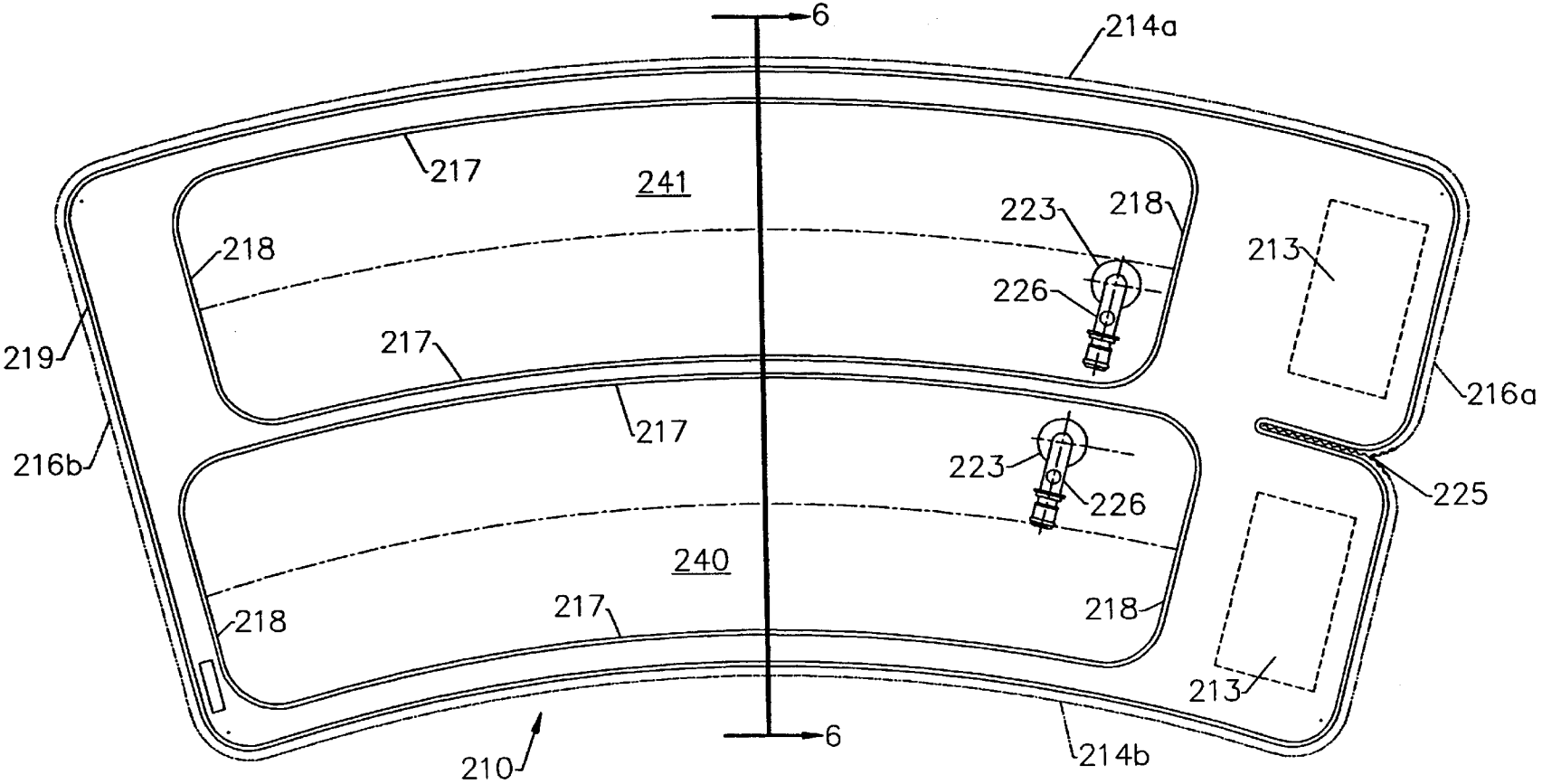
FIG. 4 is a front plan view of a compression sleeve for use with the compression system of the present invention.

Each of tubes 111 has a predetermined length such that couplers 130 are spaced-apart at longitudinal positions which accommodate the locations of the chambers 240, 241 in sleeve 210 (FIG. 4). In a preferred embodiment, conduit 110 is divided at second end 115*b* into four separate longitudinally-spaced ends which are secured to couplers 130 corresponding to each of four tubes 111. In operation, couplers 130 are releasably attached to corresponding fittings 223 in chambers 240, 241 to define pneumatic passageways for interconnecting controller 10 and compression sleeve 210 (FIG. 4). Each coupler 130 includes printed indicia 133 on the body 135 of the coupler which corresponds to like printed indicia 226 on fittings 223 in chambers 240, 241. Thus, when couplers 130 are properly connected to the corresponding fittings in sleeve 210, a continuous pneumatic passageway is formed for interconnecting controller 10 and sleeve 210 to accomplish the objectives of the invention in accordance with the aforementioned sequence. In a preferred embodiment, printed indicia 133 and printed indicia 226 are predetermined colors such that couplers 130 and inlet ports 223 in chambers 240, 241 are color-coded.

A gripping member 140 is positioned adjacent first end 115*a* of connector 100 for aligning conduit inserts 120 with outlet ports 17 of controller 10. Gripping member 140 includes a housing formed by top portion 143*a* and bottom portion 143*b*. Portions 143*a* and 143*b* are preferably molded of a suitable plastic, but may be formed by any means which accomplish the objectives of the invention described hereafter. Top portion 143*a* and bottom portion 143*b* are joined together to form the housing. The pneumatic passageways formed thereby provide a continuous passageway for permitting the compressed air from the controller 10 to flow into the chambers 240, 241 in sleeve 210 to inflate the chambers in the aforementioned sequence without directly contacting the grip.

Portions 143*a* and 143*b* include latching members 180 having inclined gripping surfaces on exterior surfaces. Latching members 180 are formed integrally, for example by molding, with portions 143*a* and 143*b* such that the latching members pivot about a resilient joint formed along an axis perpendicular to the direction in which conduit 110 passes through gripping member 140. Latching members 180 are thereby inwardly and outwardly movable in relation to portions 143*a* and 143*b*. Latching members 180 include latching lips 185 which interact with slots 18 (FIG. 2) in connector outlet ports 17 for securing gripping member 140, and thus conduit 110, to controller 10. The interaction between latching lips 185 and slots 18 thereby formed provides further transfer of the tensile stresses induced in conduit 110 through gripping member 140 to controller 10.

A user secures connector 100 to controller 10 at first end 115*a* by first squeezing latching members 180, then inserting gripping member 140 into controller outlet port 17 until latching lips 185 interact with slots 18, and then releasing the latching members so that the latching lips engage slots 18 in controller outlet port 17.

Referring now to FIG. 4, the compression sleeve 210 includes a pair of inflatable chambers 240, 241 suitable to encircle a patient's limb and adapted to render compressive pressures thereto. As shown more clearly shown in FIG. 6., the sleeves are formed from a pair of dimensionally stable, flexible sheets 220, 221. Each sheet is made of a soft fabric having a thermoplastic film 211 laminated or applied across its entire surface to form a dimensionally stable and unitary sheet. Alternatively, the sleeve can be a dimensionally stable film having a surface treatment. The thermoplastic film 211 may be formed from a suitable fluid impervious flexible thermoplastic material, such as polyvinylchloride or other suitable thermoplastic. The fabric 212 may be a relatively inelastic fabric of nylon or polyester. It is desirable to use a fabric of a suitable color and preferably a fabric with a brushed matte or napped finish. While nonwoven fabrics may be used, it is preferable to use a knitted fabric. As will be discussed in greater detail hereinafter, a portion of the fabric may serve as one part of the fastener. It is sometimes desirable that the fabric 212 covers less than the entire surface of the thermoplastic film 211. In such cases, a non-napped fabric may be laminated to the thermoplastic film and still provide an attractive and comfortable fabric surface for the sleeve.

The sleeve 210 has a pair of side edges 214*a* and 214*b*, and a pair of end edges 216*a* and 216*b* connecting the side edges 214*a* and 214*b*. The sheets 220, 221 are juxtaposed one on the other at their respective edges and ends with the thermoplastic film 211 facing each other. The sheets 220 and 221 are then sealed together along longitudinal lines 217 and lateral lines 218 to form a plurality of longitudinally disposed elongated inflatable airtight chambers 240, 241 adjacent each other. The chambers 240, 241 extend laterally in the sheets 220 and 221, and are disposed in the longitudinal arrangement between end edges 216*a* and 216*b*. In addition, the compression sleeve 210 is sealed at seam 219 around the outer periphery of juxtaposed sheets 220 and 221. When the compression sleeve is sealed at its outer edges by seam 219 the areas of the sleeve outside of the chambers are protected from intrusion of foreign material between the sheets, the area of the fastener is stabilized. When the sleeve 210 is placed on a patient's calf, the lowermost chamber 240 is located on a lower part of the leg near the patient's ankle, while the uppermost chamber 241 is located on an upper part of the leg nearer the knee.

Figure 5:
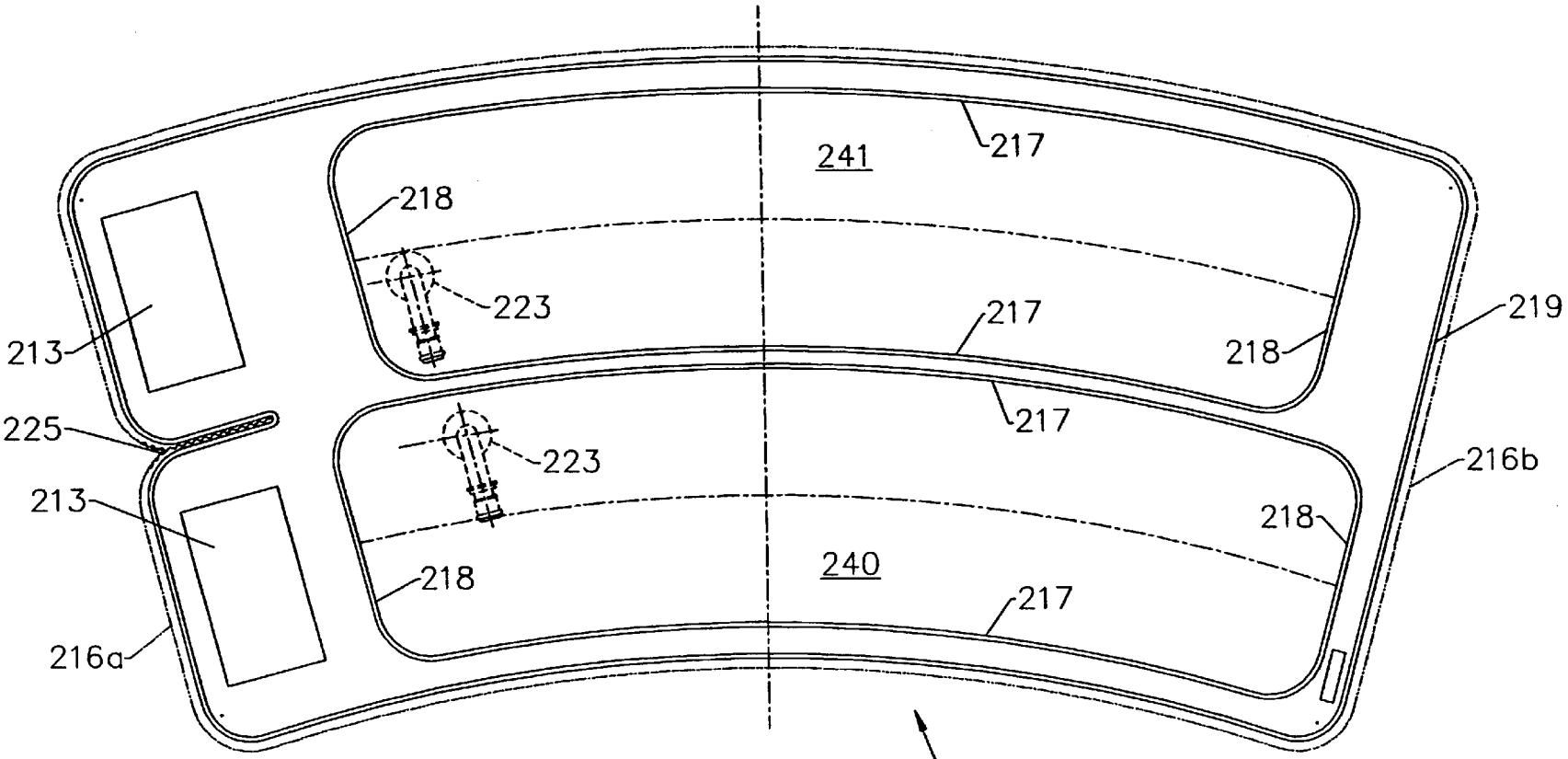
FIG. 5 is a back plan view of a compression sleeve for use with the compression system of the present invention.
Figure 6:
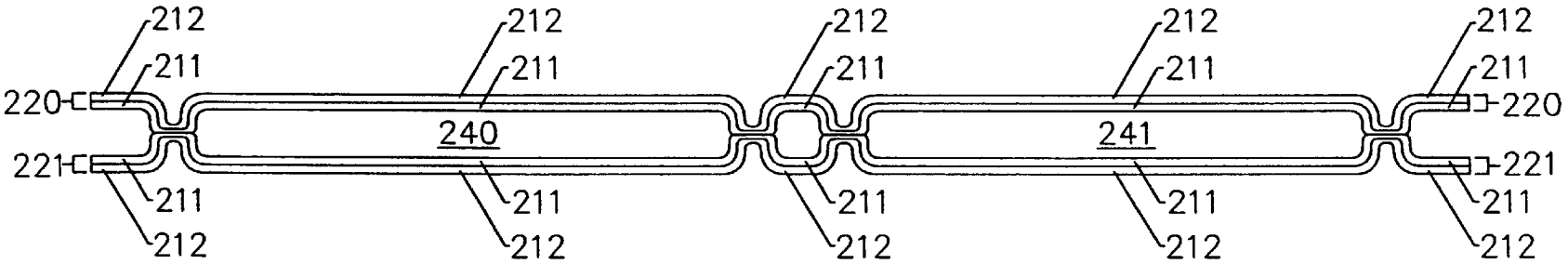
FIG. 6 is a fragmentary section view of a compression sleeve of the present invention taken along line 6—6 of FIG. 4.

The construction of the sleeve 210 is accomplished by any one or the combination of heat sealing, ultrasonic sealing, sewing, adhesives and the like. There is thus formed a compression sleeve, formed from unitary sheets, having a plurality of chambers 240, 241 which, as shown in FIG. 4 are adjacent each other. As shown in FIGS. 4–6, there may be some space between the adjacent chambers or the chambers may share a common seam. The distance between the chambers is a matter of choice depending upon the size of the sleeve and the location on the patient's limb. In an alternative embodiment of the compression sleeve of this invention, each chamber of the sleeve may, if desired, have a different volume which can be adapted to conform to the chamber location on the patient's limb. The pressure in each chamber of differing volumes remains the same because the pressure exerted by each chamber is individually controlled. As shown in FIGS. 4 and 5, in a preferred embodiment, the sleeve 210 and the chambers 240, 241 may be arcuately shaped to better fit the patient's limb. In addition, it is not necessary that the inflatable chambers occupy the entire longitudinal portion of the sleeve from end edge to end edge. For example, as shown in FIG. 4, the chambers only occupy a majority portion of the sleeve leaving the remainder to be used for other purposes, such as providing a place for positioning a first portion of the fastening means.

Each sleeve 210 has a fastening means for securing the sleeve around the patient's limb. In a preferred embodiment, the fastening means comprises a fastener strip 213 of connecting tabs extending along side edge 216*a* of a surface of the sleeve and being releasably engagable to the fabric 212 (depending upon which side of the sleeve the fastener strip 213 is located). The elongated fastener strip 213 may be a hook and loop-type fastening material, such as Velcro®. The fastener strips 213 are preferably affixed to the tabs located on the center line of each chamber 240, 241 to provide more stability of the chamber when the sleeve is secured around the patient's limb. The fastener strip 213 occupies substantially the entire length of an end edge of a sleeve. In one embodiment of this invention, the fastener strip 213 is connected to the tab portion in an area outside of the chamber. The dimensional stability provided by the laminated sheets enables the fastener strip, when placed outside the chambers to function without having the ends of the chambers overlaying each other.

Each chamber 240, 241 has a conventional quick release polycarbonate fitting 223 for rapid connection of couplings 130 to its respective conduit tube 111. Each fitting 223 has attached to it printed indicia 226 to match the indicia 133 on the conduit coupling 130. The fitting 223 is preferably secured in place to thermoplastic film 211 by well known means, such as heat sealing. The fluid inlets to chamber fittings 223 may be disposed in line with each other but the fluid inlets 225*a* and 225*b* are preferably disposed at angles for most conveniently accommodating each coupler 130 of conduit 110. A separation or slit 225 is provided at end edge 216*a* substantially coinciding with the region between adjacent chambers to promote a better fit on the patient's limb.

Figure 7:
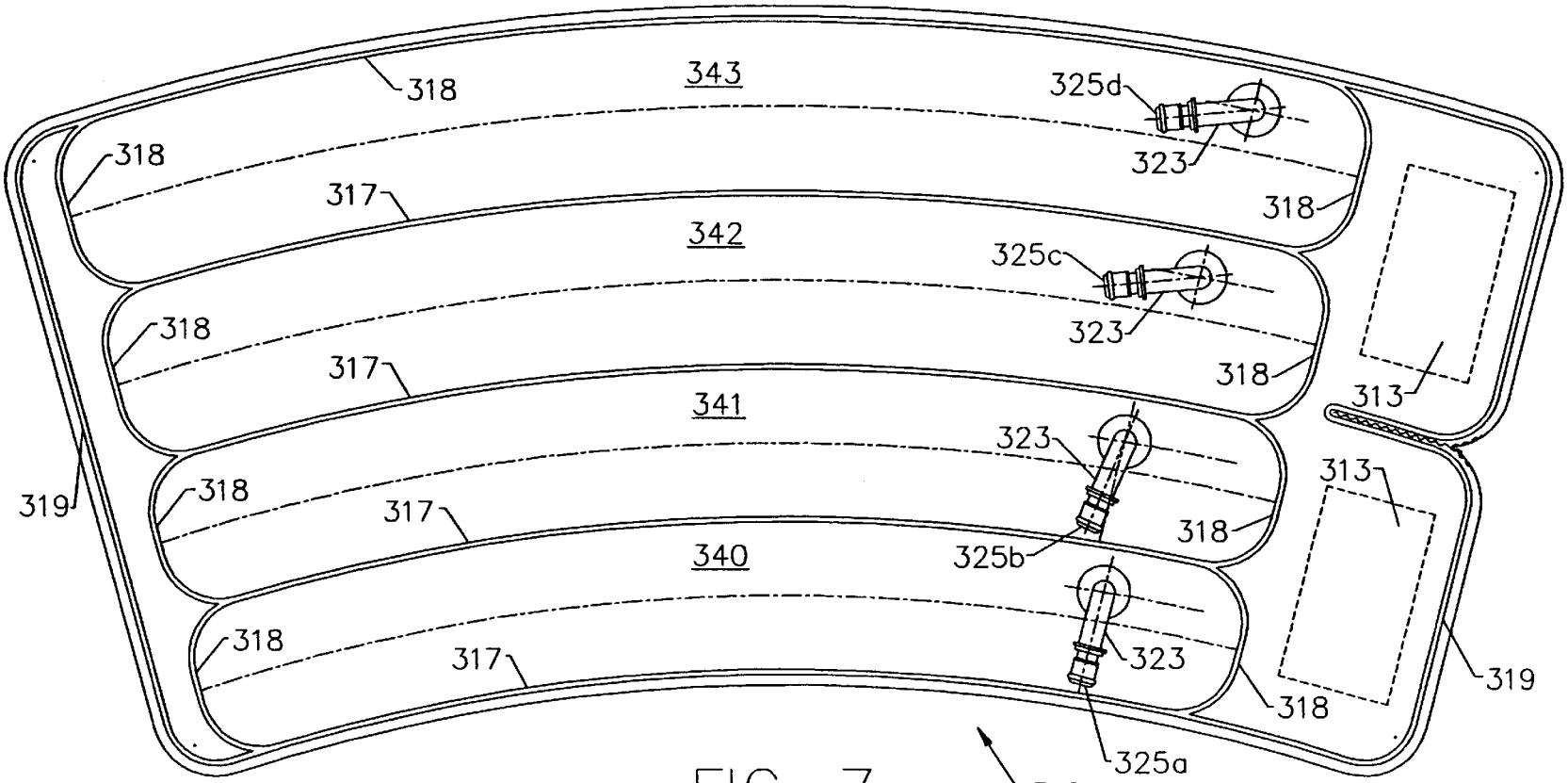
FIG. 7 is a front plan view of an alternative embodiment of a compression sleeve for use with the compression system of the present invention.

In another embodiment, the compression sleeve 310 shown in FIG. 7 has four chambers 340, 341, 342, 343 suitable to encircle a patient's limb and adapted to render compressive pressure thereto. The compression sleeve 310 has the four chambers, but is otherwise made like and operates like the two chambered sleeve 210 described in FIGS. 4–6. For example, a compression sleeve 310 is formed from a pair of dimensionally stable, flexible sheets with the thermoplastic films facing each other and sealed together along longitudinal lines 317 and lateral lines 318 to form four longitudinally disposed inflatable airtight chambers adjacent each other. The compression sleeve may also be sealed at its outer edges at seam 319. The compression sleeve 310 may be secured around the patient's limb in a manner similar to compression sleeve 210 using fastening strips 313 located on tabs at one end edge of the sleeve. Each chamber has a conventional quick release fitting 323 for rapid connection to couplings 130. The fluid inlet 325*a*, 325*b*, 325*c* and 325*d* to each respective fitting may be disposed at a different angle to each other to better accommodate the multi-tube connector.

In operation, the sleeve 210 is wrapped around the calf or thigh and releasably secured. In use, the sleeve 210 may be placed below the patient's leg preparatory for securing the limb. Next, the first fastener means and the second fastener means are passed around the patient's leg. After both the thigh and calf sleeve have been suitably wrapped around the patient's limb, the remaining part of the sleeve adjacent the side edge may be wrapped over the fabric and the fastener strip 213 may be pressed against the fabric 212. Thus, the fastener strip 213 engages with the brushed fiber of the fabric 212 such that the strips and the sheet engage and retain the sleeve in wrapped configuration. Since the fabric 212 extends entirely across the outer surface of the sleeve 210, the sleeve may be readily adjustable, as necessary, for the desired fit according to the size of the patient's limb.

After placement of the sleeve on the patient's limb and attached via connector 100 to the controller 10, the controller may be initiated in order to sequentially supply fluid to the chambers of compression sleeve 210 or compression sleeve 310. Of course, it is understood that there may be sleeves on each of the patient's legs. The controller 10 intermittently inflates the chambers during periodic compression cycles, and intermittently deflates the chambers through the connector tubes during intermediate decompression cycles as described above.

While the preferred embodiments of this invention have been illustrated in detail, it should be readily apparent to those skilled in the art that other embodiments may be conceived and fabricated without departing from the spirit and scope of this invention.

What is claimed is:

1. An elongated sleeve for applying compressive pressures against a patient's limb and accelerating deep venous blood flow therein from a source of pressurized fluid, comprising:

a pair of dimensionally stable unitary sheets sealed together along lines defining a plurality of chambers, wherein each of said unitary sheets includes a flexible sheet of thermoplastic fluid impervious material, wherein at least one of said unitary sheets has a fabric substantially laminated to the entire outside surface of the thermoplastic sheet, and wherein the lamination of the thermoplastic sheet and the fabric form a dimensionally stable unitary sheet that retains its shape during use;

a fitting secured to each chamber and adapted for releasable attachment to an individual tube of a multiple-tube connector in fluid communication with a source of pressurized fluid, wherein each fitting is secured to a corresponding chamber so that said chamber is inflated exclusively through said filling by the individual tube of said multiple-tube connector; and a fastener strip connected to said unitary sheets and comprising a plurality of hook-like elements, wherein the laminated fabric is of a type to which the hook-like elements are capable of releasably fastening, so that the fastener strip and the fabric arc cooperative for releasably securing said sleeve around the limb of a patient with said plurality of chambers encircling the limb.

2. The sleeve for applying compressive pressures against a patient's limb according to claim 1, wherein each chamber of said sleeve has a different internal volume.

3. The sleeve for applying compressive pressures against a patient's limb according to claim 1 wherein the sleeve has a pair of opposed edges having an arcuate shape.

4. The sleeve for applying compressive pressures against a patient's limb according to claim 1 wherein said sleeve has two chambers.

5. The sleeve for applying compressive pressures against a patient's limb according to claim 1 wherein said sleeve has four chambers.

6. A compression system for applying gradient sequential compression of a patient's limb and accelerating deep venous blood flow in the limb from a source of pressurized fluid, comprising:

a means for supplying a source of pressurized fluid having a connector interface comprising at least one outlet port;

a connector having a plurality of individual tubes for providing a continuous fluid passageway from said connector interface; and a compression sleeve for providing a source of pressurized fluid comprising:

a pair of dimensionally stable unitary sheets scaled together along lines defining a plurality of chambers, wherein each of said unitary sheets includes a flexible sheet of thermoplastic fluid impervious material, wherein at least one of said unitary sheets has a fabric substantially laminated to the entire outside surface of the thermoplastic sheet, and wherein the lamination of the thermoplastic sheet and the fabric form a dimensionally stable unitary sheet that retains its shape during use;

a fitting secured to each chamber and adapted for releasable attachment to an individual tube of said multiple-tube connector in fluid communication with said source of pressurized fluid; and a fastener strip connected to said unitary sheets and comprising a plurality of hook-like elements, wherein the laminated fabric is of a type to which the hook-like elements are capable of releasably fastening, so that the fastener strip and the fabric are cooperative for releasably securing said sleeve around the limb of a patient with said plurality of chambers encircling the limb.

7. The compression system according to claim 6 wherein said chambers defined by the sheets occupy a majority of the sleeve but leave a sufficient portion to support a fastening area outside the area defining the chamber.

* * * * *

UNITED STATES PATENT AND TRADEMARK OFFICE
CERTIFICATE OF CORRECTION

PATENT NO. : 6,080,120

DATED : June 27, 2000

INVENTOR(S) : Sandman et al.

It is certified that error appears in the above-identified patent and that said Letters Patent is hereby corrected as shown below:

Title page, [73] Assignee, "Beiersdorf-Jobst, Inc., Charlotte, N.C." should read --KCI New Technologies, Inc., San Antonio, Texas--.

Title page, [56] References Cited, OTHER PUBLICATIONS, page 2, column 2, line 3, "Hemostatsis" should read --Hemostasis--; page 3, column 2, line 7, "Patents:" should read --Patients:--.

Column 8, line 21, "filling" should read --fitting--; line 27, "arc" should read --are--; line 54, "scaled" should read --sealed--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*